United States Patent [19]

Myerson et al.

[11] 4,048,894

[45] Sept. 20, 1977

[54] CAPO TASTO

[76] Inventors: Elliot Lee Myerson, 1815 Grismer St., Burbank, Calif. 91504; Richard W. Gillis, 5661 Cleon St., North Hollywood, Calif. 91601

[21] Appl. No.: 650,147

[22] Filed: Jan. 19, 1976

[51] Int. Cl.[2] ..... G10D 3/04

[52] U.S. Cl. ..... 84/318

[58] Field of Search ..... 84/318

[56] References Cited

U.S. PATENT DOCUMENTS

| | | | |
|---|---|---|---|
| 390,612 | 10/1888 | Moffat | 84/318 |
| 480,429 | 8/1892 | Johnsen | 84/318 |
| 513,165 | 1/1894 | Whelan et al. | 84/318 |
| 577,627 | 2/1897 | Schuster | 84/318 |

*Primary Examiner*—Lawrence R. Franklin
*Attorney, Agent, or Firm*—Edward W. Johansen

[57] ABSTRACT

The invention is a capo tasto which attaches itself to a stem of a stringed instrument, having a fret board and strings adjacent to the fret board, and which depresses the strings against the fret board in order to change the key of the stringed instrument. The capo tasto includes a pressure bar having a length adapted to extend across the fret board of the stringed instrument, a mounting member for mounting the pressure bar on the stem of the stringed instrument so that it is disposed perpendicular to the longitudinal axis of the stem adjacent to the fret board and a pressure applicating device for applying pressure to the surface of the stem oppositely deposed to the surface on which the fret board is placed so that the pressure is transmitted through the mounting member to the pressure bar. The mounting member may either be a U-shaped member having a base, a first arm and a second arm or a C-shaped member having a first arm and a second arm. When the U-shaped member is used the capo tasto also includes a mounting bar on which the pressure bar is mounted and which is hinged pivotally to the first arm of the U-shaped member and is adapted to latch to its second arm. The pressure applicating device is a progressively stepped cam which is mounted axially on the base of the U-shaped member.

9 Claims, 8 Drawing Figures

Fig. 1.
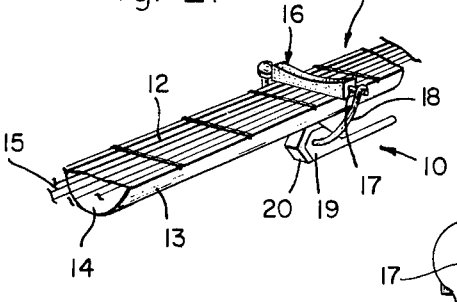
Fig. 2.
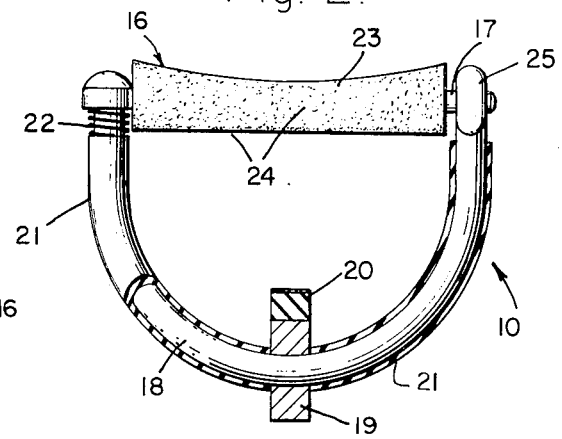
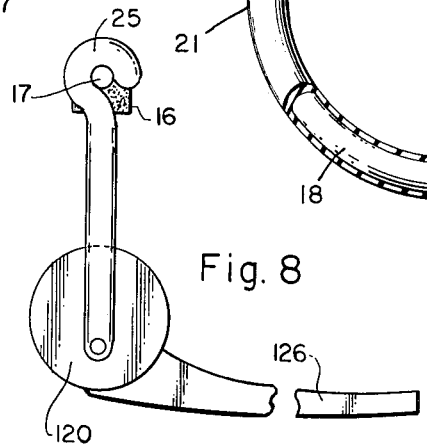
Fig. 8
Fig. 3.
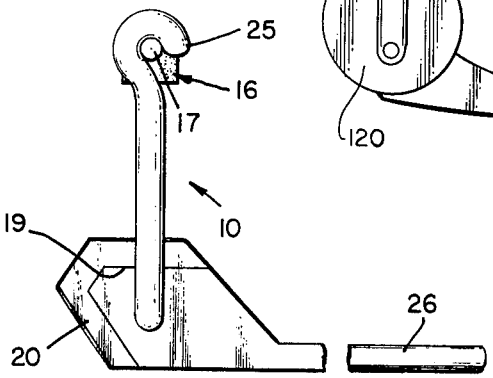
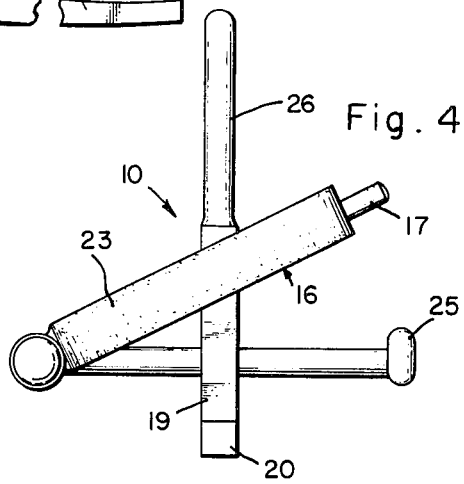
Fig. 4
Fig. 5.
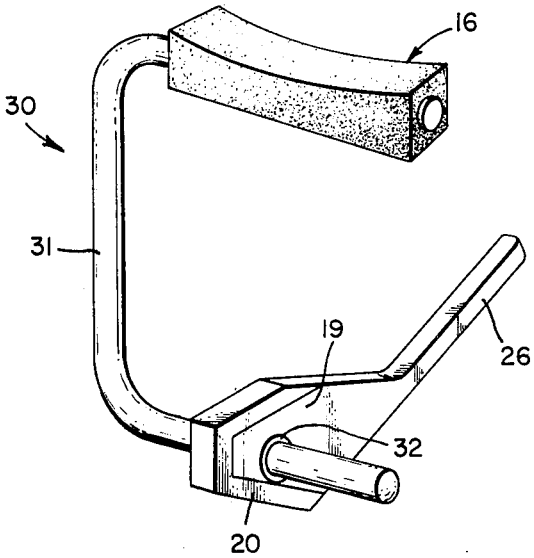
Fig. 6.
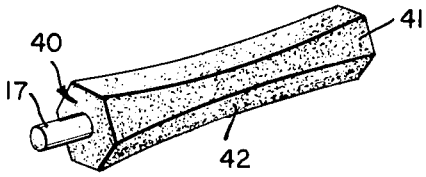
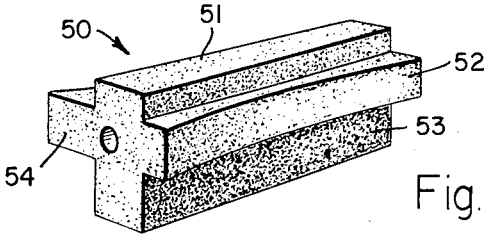
Fig. 7.

CAPO TASTO

BACKGROUND OF THE INVENTION

1. Field of the Invention

The invention relates to an attachment for a stringed instrument, such as a guitar, and more particularly to a capo which is secured to the stem of the stringed instrument so as to clamp all of its strings to its fret board at a temporary fret position.

2. Description of the Prior Art

U. S. Pat. No. 390,612, entitled Capodastro for Guitars, issued to George D. Moffat on Oct. 2, 1888 describes a capo tasto which includes a C-shaped mounting member, having a first end and a second end, which is adapted to being disposed about the stem of a stringed instrument perpendicular to the longitudinal axis of the stem. The capo tasto also includes a pressure bar, having a first end and a second end, which is hinged or pivoted at a point intermediate to its first and second ends to the first end of the C-shaped mounting member and disposed in the same plane as the C-shaped mounting member. The pressure bar may be provided with a pad of cork or any other suitable material so that the pressure bar does not injure the strings. Furthermore, the pressure bar is self-adjusting and is free to tilt about its point of pivotal suspension so that it can properly depress the strings regardless of the capo tasto's position on the guitar-stem. The capo tasto finally includes a cam lever mechanically coupled to the second end of the C-shaped mounting member and disposed in the same plane as the C-shaped mounting member so that the cam lever is parallel to the transverse axis of the guitar-stem. The cam lever is a disc which is eccentrically pivoted upon the second end of the C-shaped mounting member. An alternative embodiment of this capo tasto may include a bearing plate, that is operated by an adjusting screw so that the capo tasto may be clamped to the guitar neck. The inability of this capo tasto to center itself makes it difficult for a musician to easily and speedily change from one fret position to another fret position.

Two of the most commonly used capo tastos are the Bill Russell capo and the Jim Dunlop capo. The Bill Russell capo is the subject of the U. S. Pat. No. 1,788,636, entitled Capo Tasto, issued to Willard H. Russell On Jan. 13, 1931 and includes a rubber pressure bar, which presses against the strings of a stringed instrument, a rigid reinforcing plate which is positioned inside of or on top of the rubber pressure bar and to which the rubber pressure bar is secured, an elastic strip, a portion of which is secured to a first lug on the rubber pressure bar at one end extending over the top of the rubber pressure bar, and secured to a second lug on the rubber pressure bar. The capo tasto is secured to the stem of the stringed instrument by wrapping the remaining portion of the elastic strip about the bottom surface of the stem. The tension on the elastic strip is maintained by a plurality of eyelets positioned on the elastic strip to which a set of pins are coupled. The Jim Dunlop capo is the subject of U.S. Pat. No. 3,185,012, entitled Capo Tasto, issued on Nov. 3, 1965 to James Dunlop and includes a channel of a roughly U-shaped cross-sectional contour molded from plastic, the side flanges which are arranged to diverge slightly and have bevelled end edges, a non-elastic cord is coupled to a cam lever, which is aligned perpendicular to the longitudinal axis of the stem of a stringed instrument on which it is placed and which secures the capo tasto in place on the stem of the stringed instrument.

The disadvantages of both the Jim Dunlop capo and the Bill Russel capo is that a musician cannot easily and speedily change from one fret position to another fret position and he must use both his hands to do so. Furthermore, neither of these capos is very durable and each of them has a tendency to wear out quickly.

The inventors are also aware of another set of capos which are manufactured by Hamilton and each of which includes a U-shaped mounting member, having a base, a first arm and a second arm, also a mounting bar, having a first end and a second end, with its first end pivotally hinged to the first arm of the U-shaped member and its second end adapted to latch to the second arm of the U-shaped mounting member, a pressure bar, which mounts on the mounting bar. One of these capos has a screw adjusted pressure plate, that is disposed on the base of the U-shaped mounting member. The other capo is secured to the stem of a stringed instrument by a positively engaging spring device disposed on the base of the U-shaped mounting member. These capos are aesthetically unattractive and require the musician to use his two hands to change from one fret position to another fret position.

U. S. Pat. No. 3,823,247, entitled Capo Tasto issued to Herbert Bauerfeind on July 9, 1974, describes a capo tasto which includes a pressure bar, a bowed clamp member hinged to one end of the pressure bar, and a device which interengages the other, unhinged end of the pressure bar in order to secure the capo tasto to the guitar. The pressure bar has a comb-like part, the teeth of which are closely spaced and adapted to press on the strings of the instrument. The disadvantage in using this capo tasto is that a musician must use both his hands to change from one fret position to another fret position. The advantage of this capo tasto is its aesthetic qualities in that it is practically invisible when placed on a stringed instrument.

SUMMARY OF THE INVENTION

In view of the foregoing factors and conditions of the prior art it is a primary object of the present invention to provide a capo tasto for a particular stringed instrument which can be easily adapted to variations of the particular stringed instrument.

It is another object of the present invention to provide a capo tasto for a stringed instrument that is durable and long lasting in its construction and that has a minimum of moving parts.

It is also another object of the present invention to provide a capo tasto for a stringed instrument that may be changed speedily and easily with one hand.

It is still another object of the present invention to provide a capo tasto for a stringed instrument which does not aesthetically detract from the appearance of the stringed instrument.

It is yet another object of the present invention to provide a capo tasto for a stringed instrument which is self-centering on the stem of the stringed instrument.

In accordance with an embodiment of the present invention a capo tasto for a stringed instrument, having a stem or neck, a fret board with several fret positions mounted on the stem, and a set of strings, has been described. The capo tasto includes a mounting member that may be either C-shaped or U-shaped. The C-shaped mounting member has a first arm and a second arm and is adapted to being positioned perpendicular to the longitudinal axis of the stem of the stringed instrument with the first arm running parallel to the transverse axis of the stem and adjacent to the fret board and the second arm also running parallel to the transverse axis of the stem adjacent to the underside of the stem. When the U-shaped mounting member, also having a base, a first arm and a second arm, is used, it is positioned so that both its first and second arms are orthogonal to both the transverse and longitudinal axes of the stem and adjacent to the sides of the stem and its base is adjacent to the underside of the stem. The capo tasto also includes a mounting bar that is pivotally hinged to the first arm of the U-shaped mounting member at one of its ends and adapted to latch the second arm of the U-shaped mounting member at its other end. The mounting bar, when latched, is positioned adjacent to the fret board running parallel to the transverse axis of the stem. The capo tasto further includes a pressure bar, that is rectilinear in its cross-section, but which has a concave side and three flat sides running longitudinally, mounted on the first arm of the C-shaped mounting member and on the mounting bar of the U-shaped mounting member. Finally, the capo tasto includes a cam lever disposed on the second arm of the C-shaped mounting member and on the base of the U-shaped mounting member. The cam lever is a progressively stepped cam that is disposed on the mounting member so that when it is positioned on the stem of the stringed instrument it runs parallel to the longitudinal axis of the stem.

The features of the present invention which are believed to be novel are set forth with particularity in the appended claims. Other objects and many more of the attendant advantages of this invention will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a perspective view of a stem of a stringed instrument, having a fret board and a set of strings, on which a capo tasto, constructed in accordance with the principles of the present invention, is mounted.

FIG. 2 is a front elevation view of the capo tasto of FIG. 1 having a U-shaped mounting member.

FIG. 3 is a side elevation view of the capo tasto of FIG. 1. FIG. 4 is a top plan view of the capo tasto of FIG. 1.

FIG. 5 is a perspective view of a capo tasto, similar to the capo tasto of FIG. 1, having a C-shaped mounting member and a pressure bar of a first type.

FIG. 6 is a perspective view of a pressure bar of a second type.

FIG. 7 is a perspective view of a pressure bar of a third type.

FIG. 8 is a side elevation view of a capo tasto having an eccentrically mounted disc and being constructed in accordance with the principles of the present invention.

DESCRIPTION OF THE PREFERRED EMBODIMENT

The present invention is a capo tasto which is used on a stringed instrument for changing the key of the stringed instrument. In order to best understand the present invention it is necessary to view a preferred embodiment of the present invention in use on a stringed instrument. Referring to FIG. 1 a capo tasto 10 is mounted on a stem 11 of a stringed instrument having a fret board 12 disposed on its top surface, two curved side surfaces 13 and a bottom surface 14. The stringed instrument has a set of strings 15 running parallel to the stem 11 and adjacent to the fret board 12. The capo tasto 10 includes a pressure bar 16, a mounting bar 17 on which the pressure bar 16 is mounted, a U-shaped member 18 having a base, a first arm and a second arm with the mounting bar 17 pivotally hinged at one end to its first arm and adapted at the other end to latch to its second arm, and a progressively stepped cam 19 which is disposed parallel to the stem 11 and which is axially mounted to the base of the U-shaped member 18. The progressively stepped cam 19 has a cloth-covered rubber layer 20 in order to protect the bottom surface 14 of the stem 12.

Referring now to FIG. 2, another embodiment of the capo tasto 10 may also include a pair of rubber tubes 21 which encase both arms of the U-shaped member 18 in order to center the progressively stepped cam 19 on the base of the U-shaped member 18. Tension on the mounting bar 17 is provided by a coiled spring disposed on the first arm of the U-shaped member 18 between the hinged mounting bar 17 and one of the rubber tubes 21. From FIG. 2 it can readily be noted that the pressure bar 16 has a concave surface 23 and three flat surfaces 24, that are orthogonal to each other, disposed parallel to the transverse axis of the stem 11 of the string instrument when the capo tasto 10 is mounted thereon.

Referring now to FIG. 3 in conjunction with FIG. 2 the capo tasto 10 has a latch 25 on the second arm of the U-shaped member 18. The latch 25 is in the shape of a crook and allows the unhinged end of the mounting bar 17 to fasten itself within its curved section. The inventors have borrowed this latch 25 from other capo tastos and have also found that other types of latching devices may be used with their invention.

Referring specifically to FIG. 3 the progressively stepped cam 19 is shown having a handle 26. The progressively stepped cam 19 is disposed parallel to the stem, is mounted axially on the base of the U-shaped member 18 and is disposed so that the handle 26 points backward from the playing side of the fret board 12 in order that the musician's hands not be encumbered by the handle 26 while he is playing the stringed instrument.

The hinging action of the mounting bar 17 can best be understood by reference to FIG. 4 which is a top plan view of the capo tasto 10. In applying the capo tasto 10 to the stem 11 of the stringed instrument the mounting bar 17 is unlatched from the latch 25 and pivoted open so that the U-shaped member 18 may be placed with its first and second arms adjacent to the side surfaces 13 and its base adjacent to the bottom surface 14. The progressively stepped cam 19 is disposed parallel to the stem 11 and is also aligned with the center line of the stem 11 adjacent to its bottom surface 14. Once the capo tasto 10 is in this position the mounting bar 17 is fastened by the latch 25. The progressively stepped cam 19 is adjusted so that a pressure is exerted against the bottom surface 14 of the stem 11 and transmitted through the U-shaped member 18 and the mounting bar 17 to the pressure bar 16 which presses the strings 15 against the fret board 12 of the stringed instrument.

The inventors have also developed an alternative embodiment of their invention which can best be understood by reference to FIG. 5 which is a perspective drawing of a second capo tasto 30 which includes a pressure bar 16, a progressively stepped cam 19 and a C-shaped member 31 having a first arm and a second arm with the pressure bar transverse 16 being disposed to the stem 11 and also being mounted on the first arm and with the progressively stepped cam 19 being mounted axially on the second arm. The progressively stepped cam 19 is centered on the second arm of the C-shaped member 31 and held in place by a pair of rubber o-rings 32 placed on either side of the progressively stepped cam 19. FIG. 6 illustrates a pressure bar 40 of a second type which has a hexagonal cross-section and has a set of four flat surfaces 41 and two concave surfaces 42, differing in degrees of concavity. FIG. 7 illustrates a pressure bar 50 of a third type which has a cross-section of a cross with a short top surface 51, a short right side surface 52, a long bottom surface 53 and a long side surface 54. The top and bottom surfaces 51 and 53 are flat. The long side surfaces 52 and 54 are concave. The combining of flat surfaces and concave surfaces on the pressure bars enable the capo tastos of the present invention to be used on a variety of stringed instruments. The use of the pressure bar 50 of the third type further enhances the adaptability of the capo tastos on which it is used.

The inventors emphasize that the disposition of the progressively stepped cam 19 so that it is parallel to the stem 11 is necessary to provide an improved capo tasto 10 which is easy to center while a musician is changing from one fret position to another fret position.

Referring now to FIG. 8 in conjunction with FIG. 2, the capo tasto 10 may have instead of the progressively stepped cam 19 a disc 120 which is eccentrically mounted on the base of the U-shaped member 18 and has a handle 126 which is disposed so that it points backward from the playing side of the fret board in order that the musician's hands not be encumbered by the handle 126 while he is playing the stringed instrument.

Until the present invention capo tastos were not versatile enough to be used on both a flat surface of one stringed instrument and a curved surface of a similar stringed instrument. Furthermore, the capo tastos of the prior art were difficult to use and required two hands to change from one fret position to another. The advantage of a capo tasto of the present invention is that it not only may be easily and speedily changed from one fret position to another with one hand but also it has a long useful life in that its moving parts are formed from a durable material such as a plastic or a metal. The progressively stepped cam may be replaced by a disc eccentrically mounted on the base of the U-shaped member or on the second arm of the C-shaped member. Further illustrating the versatility of the present invention is that a variety of pressure bars, either a C-shaped member or a U-shaped member and either a centrically mounted progressively stepped cam or a eccentrically mounted disc may be mixed to form various embodiments of the present invention.

From the foregoing it can be seen that a capo tasto has been described which is not only functionally superior to prior art capo tastos but which is more aesthetically appealing than the same capo tastos. The capo tasto includes a mounting member, a pressure bar, a mounting bar on which the pressure bar is mounted, and a pressure applicating device. Furthermore, it should be noted that the schematics of the capo tasto are not drawn to scale and the distances of the between figures are not to be considered significant.

Accordingly, it is intended that the foregoing disclosure and showing made in the drawing shall be considered only as illustrations of the principle of the present invention.

What is claimed is:

1. A capo tasto for attachment to a stem of a stringed instrument, said stem having a longitudinal axis, an upper surface and a lower surface, a fret board disposed on said upper surface and a plurality of strings disposed parallel to said longitudinal axis, said capo tasto comprising:

a. a pressure bar having a length adapted to extend across said stem transversely to said longitudinal axis adjacent to said fret board;

b. mounting means for mounting said pressure bar on said stem above said strings, said mounting means including a C-shaped member having a first arm and a second arm, said pressure bar being mechanically coupled to said first arm;

c. cam means axially mounted to said second arm for rotation thereabout, said rotation being effective to apply pressure to said lower surface, said pressure being transmitted through said mounting means to said pressure bar to depress said strings; and d. means for holding said cam means against axial movement along said second arm of said C-shaped member at such a location that said cam means is centered on said stem when said capo tasto is attached thereto.

2. A capo tasto according to claim 1 wherein said cam means comprises a progressively stepped cam which is axially mounted to said second arm of said C-shaped mounting member.

3. A capo tasto according to claim 1 wherein said cam means comprises a disc which is eccentrically mounted to said second arm of said C-shaped mounting member.

4. A capo tasto according to claim 1 wherein said pressure bar has three flat orthogonal surfaces and one concave surface which are disposed parallel to the transverse axis of the stem of the stringed instrument, said pressure bar formed from a pliable material so that the strings of the stringed instrument will not be damaged when the pressure bar is applied against them.

5. A capo tasto for attachment to a stem of a stringed instrument, said stem having a longitudinal axis, an upper surface and a lower surface, a fret board disposed on said upper surface and a plurality of strings disposed parallel to said longitudinal axis, said capo tasto comprising:

a. a pressure bar having a length adapted to extent across said stem transversely to said longitudinal axis adjacent to said fret board;

b. mounting means for mounting said pressure bar on said stem above said strings, said mounting means including a U-shaped member having a base, a first arm and a second arm, said pressure bar being pivotally hinged to said first arm and releasably latched to said second arm;

c. cam means axially mounted to said base for rotation thereabout, said rotation being effective to apply pressure to said lower surface, said pressure being transmitted through said mounting means to said pressure bar to depress said strings; and d. means for holding said cam means against axial movement along said base of said U-shaped member at such a location that cam means is centered on said stem when said capo tasto is attached thereto.

6. A capo tasto according to claim 5 wherein said pressure bar has three flat orthogonal surfaces and one concave surface which are disposed parallel to the transverse axis of the stem of the stringed instrument, said pressure bar formed from a pliable material so that the strings of the stringed instrument will not be damaged when the pressure bar is applied against them.

7. A capo tasto according to claim 5 wherein said pressure bar has four flat surfaces and two concave surfaces, differing in degree of concavity, which are disposed parallel to the transverse axis of the stem of the stringed instrument, said pressure bar formed from a pliable material so that the strings of the stringed instrument will not be damaged when the pressure bar is appliedagainst them.

8. A capo tasto according to claim 5 wherein said cam means comprises a disc which is eccentrically mounted to said base of said U-shaped mounting member.

9. A capo tasto according to claim 5 wherein said cam means comprises a progressively stepped cam which is axially mounted to said base of said U-shaped member.

* * * * *